US007520229B2

(12) United States Patent
Hillenbrand et al.

(10) Patent No.: US 7,520,229 B2
(45) Date of Patent: Apr. 21, 2009

(54) GRIPPER DEVICE FOR A TUFTING MACHINE

(75) Inventors: Bernd Hillenbrand, Albstadt (DE); Hans Werner Moser, Obernheim (DE); Andrea Maute, Albstadt (DE); Roland Wäschle, Albstadt (DE); Timo Kaas, Balingen (DE)

(73) Assignee: Groz-Beckert KG, Albstadt (DE)

( * ) Notice: Subject to any disclaimer, the term of this patent is extended or adjusted under 35 U.S.C. 154(b) by 62 days.

(21) Appl. No.: 11/709,779

(22) Filed: Feb. 23, 2007

(65) Prior Publication Data

US 2007/0199489 A1 Aug. 30, 2007

(30) Foreign Application Priority Data

Feb. 24, 2006 (EP) ..... 06003768

(51) Int. Cl.
*D05C 15/22* (2006.01)
*D05C 15/24* (2006.01)

(52) U.S. Cl. ..... 112/80.5; 112/80.6

(58) Field of Classification Search ..... 112/80.5, 112/80.51, 80.52, 80.53, 80.55, 80.56, 80.58, 112/80.59, 80.7, 80.71
See application file for complete search history.

(56) References Cited

U.S. PATENT DOCUMENTS 2,800,096 A 7/1957 Signoret
3,735,715 A * 5/1973 Passons et al. ..... 112/80.51
4,155,318 A * 5/1979 Yamamoto ..... 112/80.59
4,522,132 A * 6/1985 Slattery ..... 112/80.51
4,557,209 A * 12/1985 Watkins ..... 112/80.3
5,738,027 A * 4/1998 White ..... 112/80.55

FOREIGN PATENT DOCUMENTS

EP 0 200 810 A1 11/1986
WO WO 01/29302 A1 4/2001

* cited by examiner

*Primary Examiner*—Ismael Izaguirre
(74) *Attorney, Agent, or Firm*—Fitch, Even, Tabin & Flannery; Norman N. Kunitz

(57) ABSTRACT

A gripper device in accordance with the invention comprises a gripper (3) and a counter knife element (4) that are fabricated separately and joined. As a result of this, optimal material combinations are possible, which will deal with both types of wear, namely between the gripper (3) and the tufting needle (5), on the one hand, and between the knife (6) and the counter knife element (4), on the other hand. The gripper module (1) accommodates the counter knife element (4), which, in turn, supports the gripper (3). The two parts may be joined by caulking, cementing, riveting, screwing or similar measures, or they may be cast together in the gripper module (1). The cutting of the loop is done exclusively between the counter knife element (4) and the knife (6).

13 Claims, 4 Drawing Sheets

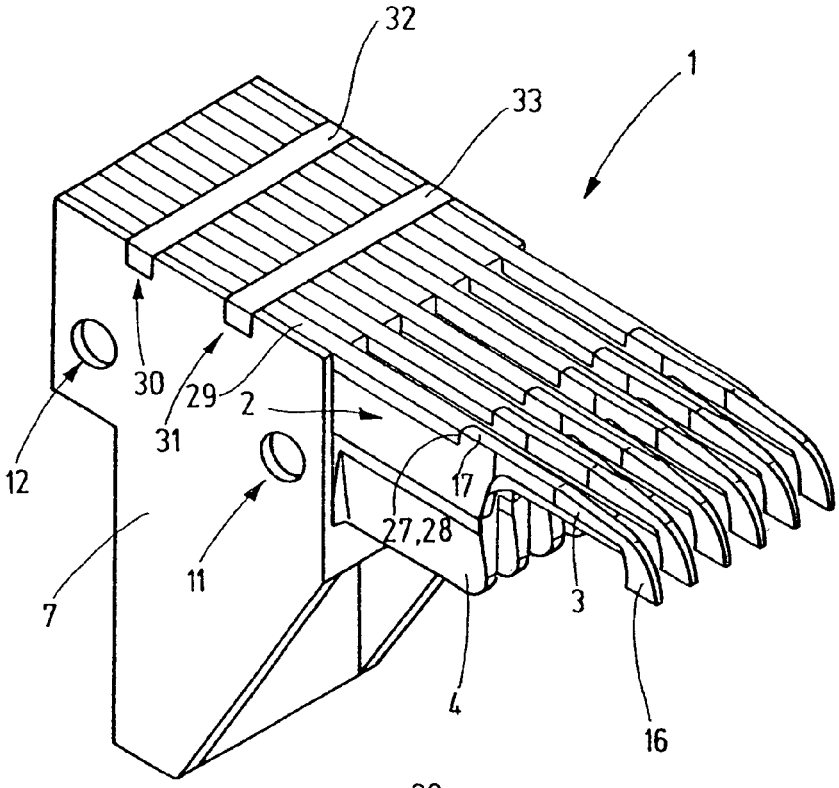
Fig.2
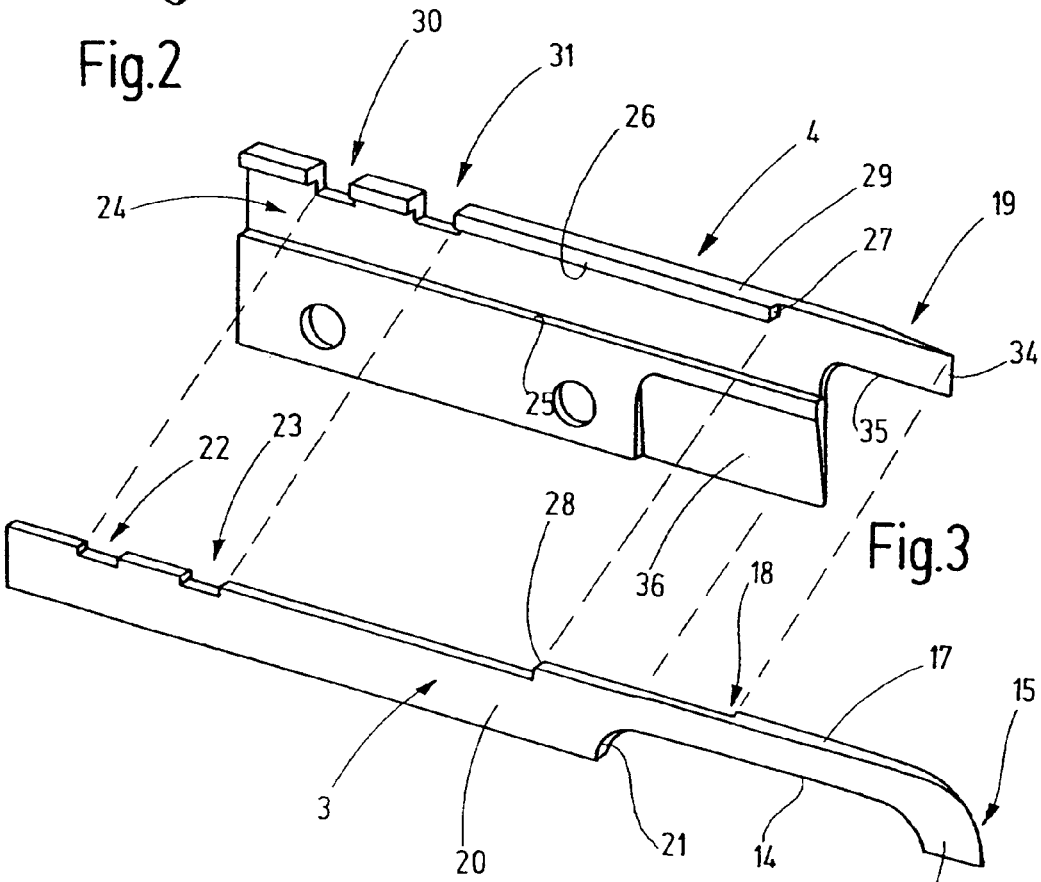
Fig.3
Fig.4

GRIPPER DEVICE FOR A TUFTING MACHINE

CROSS-REFERENCE TO RELATED APPLICATIONS

This Application is a U.S. Utility Patent Application which claims priority from European Application No. 06 003 768.6, filed Feb. 24, 2006, the complete disclosure of which is incorporated herein by reference.

BACKGROUND OF THE INVENTION

The invention relates to a gripper device for a tufting machine, in particular for the manufacture of carpets with cut pile.

Frequently, tufting processes are used in the manufacture of carpets. Referring to such tufting methods, a flat support material (so-called backing) is provided with a pile. The pile consists of a large number of individual pieces of yarn which are punched by tufting needles—row by row—into the backing. In so doing, the backing is gradually advanced stitch by stitch underneath a row of needles. The thusly formed loops are temporarily held by a gripper arranged on the opposite side and are cut by means of a knife, consistent with the advance cycle of the backing. Consequently, a cut pile is obtained, which is also referred to as velour.

In so doing, the gripper device interacts with the tufting needles, on the one hand, and with the knives, on the other hand. When the loops are picked up, the grippers' tips contact the tufting needles. As a result of the relatively high contact pressure exerted by the knives on the grippers, the grippers are pressed against the needles. As a result, the needles wear out relatively rapidly. Therefore, the gripper tip should not be too hard, yet still exhibit good wear characteristics.

In addition, the cutting edges and the cutting surfaces on the gripper devices wear out relatively rapidly due to the frictional contact with the knife during the shearing movement. The knives move with high pressure and diagonally across the cutting edges of the gripper devices, thus requiring high edge strength and high hardness of the gripper devices.

In practical applications it has been known to make the grippers of high-speed steel (HSS). However, such grippers result in a rapid wear of the needles. Furthermore, known practical applications have shown grippers consisting of relatively soft material; such grippers are provided with hard metal inserts for the blade, said inserts being soldered or cemented in place. The adjustment of such grippers on the tufting machine is difficult. Furthermore, the precise material properties of the gripper body can be affected by thermal stress when the hard metal blades are soldered in, or the gripper body can be distorted. It is difficult to maintain the desired precision. In addition, hairline cracks may occur in the hard metal bodies.

If, in contrast, the grippers consist of only one uniform material, a compromise can hardly be found regarding the wear characteristics during the interaction with the tufting needle, on the one hand, and regarding the interaction with the knife, on the other hand.

Considering this, it is the object of the invention to improve the gripper device.

SUMMARY OF THE INVENTION

The above object is generally attained with the gripper device in accordance with the present invention, which comprises a gripper having at least a first gripper section which is provided with a gripper edge for picking up loops. The gripper is associated with a counter knife element having a cutting edge and is designed for accepting the loops from the gripper element. The counter knife element supports or holds the gripper, which is a separate element. Preferably, to achieve this result, the counter knife element itself is held, for example, in a modular block and provided with a connecting means for the support of the gripper. The connecting means, for example, may be a continuous longitudinal groove in which the gripper is placed. The gripper may be immovably secured in the groove, for example, by means of positive-closing elements, or by clamping action, or by other measures.

In order to connect the gripper with the counter knife element, both can be cast together in a modular block. The gripper and the counter knife element may be soldered, welded, cemented, caulked or otherwise joined together. If the joining technique is connected with a thermal stress of the material of the gripper and/or the counter knife element, the joint may be at a distance from the gripper section and from the cutting edge. Preferably, the flat sides of the cutting extension bearing the cutting edge and of the gripper section are in abutment with each other, with or without being pre-tensioned.

Inasmuch as the gripper and the counter knife element are separate entities, they can be handled separately regarding the selection of material, as well as regarding the required machining processes such as straightening, hardening, polishing, etc. For example, the gripper can consist of a tough, but not too hard, material that will be subject to minimal wear in contact with the tufting needles and, at the same time, will cause minimal wear to the tufting needles. For example, the gripper can be made of a not too hard, somewhat flexible steel. In contrast, the counter knife element can be made of a particularly wear-resistant hard material, e.g., HSS, in order to wear minimally during contact with the knives.

Inasmuch as the counter knife element supports the gripper, a good relative alignment of the gripper and the counter knife is ensured. The counter knife element can be directly supported in a modular block and thus be aligned well with respect to the knife. If the grippers are reasonably flexible, they can align themselves on the tufting needles.

The gripper edge and the cutting edge are preferably straight. However, if needed, they may also be provided with a certain curvature. Preferably, they are joined in a flush manner. This permits the uninterrupted transfer of the loops from the gripper edge to the cutting edge.

Preferably, the gripper edge and the cutting edge are aligned parallel with respect to each other, whereby they preferably adjoin each other. In so doing, when the loops are cut, consistent lengths are obtained, so that a smooth, uniform cut pile is obtained.

Preferably, one end of the gripper is provided with a hook. This hook prevents the loops from slipping off during the reverse stroke of the gripper, said stroke being necessary in order to permit the renewed punching of the tufting needles through the backing.

Preferably, the gripper has on its end a shaft which is accommodated by a cutout of the counter knife element. As mentioned, the cutout may be a groove, in which the gripper is immovably supported. Consequently, the gripper device is designed exclusively for the manufacture of cut pile.

Additional details of advantageous embodiments of the invention are the subject matter of the drawings, the description and of the subordinate claims.

The drawings illustrate the embodiments of the invention.

BRIEF DESCRIPTION OF THE DRAWINGS

FIG. 2. is a different perspective view of the gripper device in accordance with FIG. 1.

FIG. 3 is a perspective view of the counter knife element of the gripper device in accordance with FIG. 2.

FIG. 4 is a perspective view of the gripper of the gripper device in accordance with FIG. 2.

DETAILED DESCRIPTION OF THE INVENTION

Figure 1:
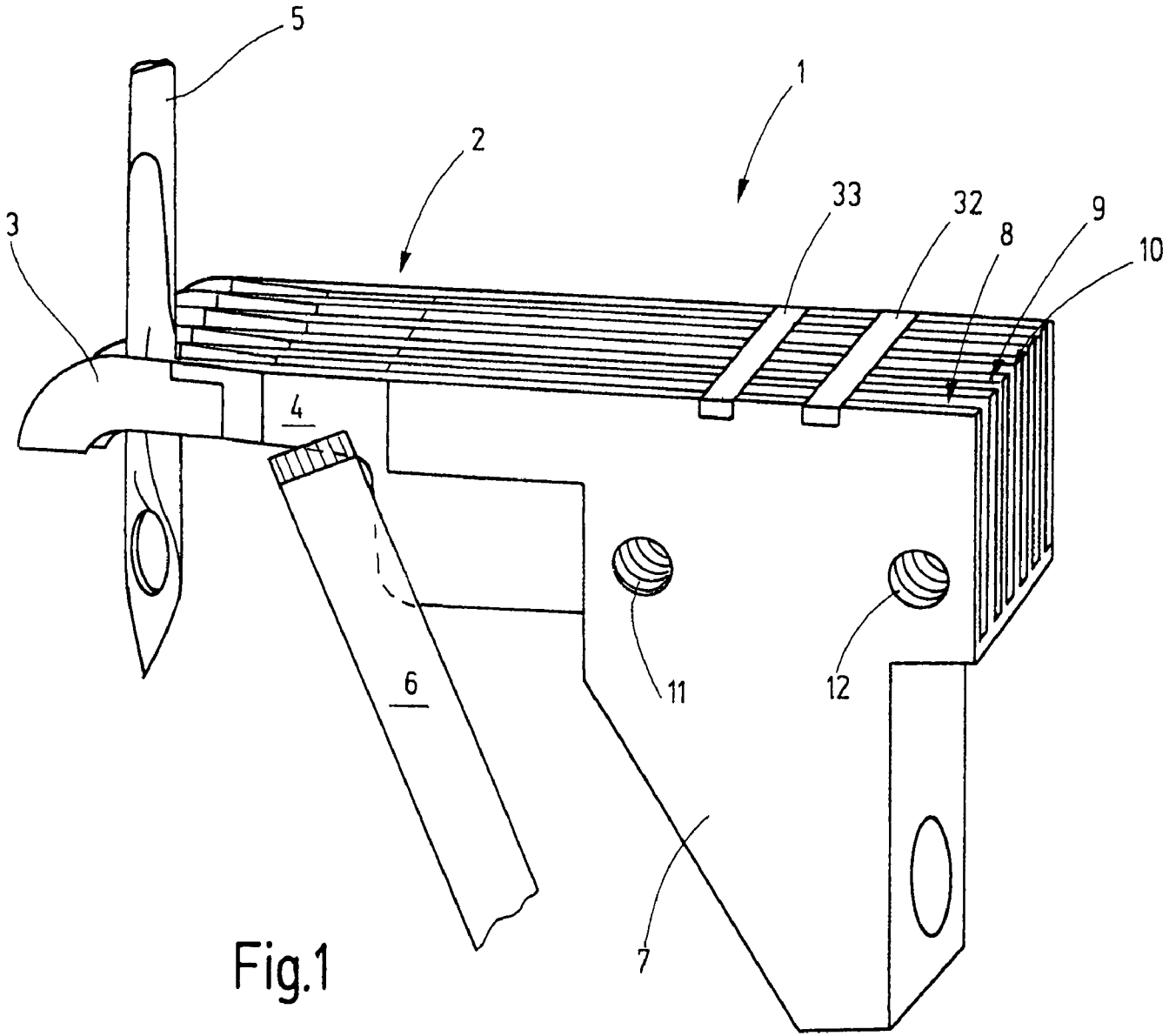
FIG. 1.*is* a schematic perspective view of a gripper device with a tufting needle and a knife.

FIG. 1 shows a gripper module 1 for a tufting machine, said module being associated with the gripper devices 2. Each gripper device 2 comprises a gripper 3 and a counter knife element 4. The gripper devices 2 interact with tufting needles, one tufting needle 5 being shown. The counter knife elements 4 interact with knives, one knife 6 being shown. The gripper devices 2 are held in the gripper module 1 in a congruent and parallel manner. To achieve this, the gripper module 1 has a body 7 having, on its upper side, adjacent deep grooves 8, 9, 10, in which the gripper devices 2 are seated. In order to hold said gripper devices stationarily and securely in place in the body 7, the through bores 11, 12 are provided in the body 7, said bores extending through the counter knife elements 4. The bores 11, 12 accommodate bolts that are not illustrated in detail.

FIGS. 3 and 4 show the counter knife element 4 and the gripper 3 separately. The dashed lines are related associate structures on the gripper 3 and on the counter knife element 4 to indicate how the gripper 3 and the counter knife element 4 fit together.

The gripper 3 has a first gripper section 13 that has a straight gripper edge 14. The gripper edge 13 is configured as a flat sheet metal fin. On its free end 15, said fin becomes a hook 16 that extends, as a projection, away from the gripper edge 14. In longitudinal direction, the gripper edge 14 is straight and transversely rounded. It is not sharp, in particular, so that it will potentially not harm a picked up loop.

Two flat sides extend from the gripper edge 14, said sides ending on a straight back 17. The back 17 projects from the hook 16 as a flat surface. On the flat side facing the counter knife element 4, the gripper 3 has a step 18, which acts to accommodate a knife extension 19 on the counter knife element 4. The step 18 may preferably be located on the front third of the gripper edge 14. The front third is located in the vicinity of the hook 16. In so doing, facing away from the viewer, the step 18 extends over the entire height of the flat side in FIG. 4, said side being otherwise essentially plane. Likewise, the opposite side facing the viewer is flat.

Adjoining the gripper section 13 is a shaft 20, which has a substantially rectangular cross-section. At a step 21, the gripper edge 14 becomes the shaft 20. The cutouts 22, 23 can be used to fix the gripper in position in the counter knife element 4.

The counter knife element 4 has a flat body with a rectangular cross-section and with a knife extension 19 on its right narrow edge (in FIG. 3). The flat body is provided with a groove 24 having a rectangular cross-section that corresponds to the cross-section of the shaft 20 of the gripper 3, so that said gripper can be accommodated by the groove 24. The groove is limited by two flanks 25, 26, in which case the upper flank 26 is formed by an edge. This edge ends just before the knife extension 19 in a step 27. This step 27 is associated with a step 28 provided on the back 17. Regarding their height and arrangement, the steps are matched in such a manner that, when the gripper 3 and the counter knife element 4 are joined, the upper side of the gripper module 1 becomes a smooth surface. This is obvious in FIG. 2, in particular. At the steps 27, 28, the back 17 of the gripper 3 becomes a back 29 of the counter knife element 4. Furthermore, FIG. 2 shows two strips 32, 33, placed in the cutouts 30, 31 of the counter knife element 4, said strips securing the grippers 3 against axial movement.

While the steps 27, 28 are interleaved and form an externally smooth surface, the front, preferably flat, face 34 of the knife extension 19 adjoins the step 18 in smooth manner. Without becoming caught on the face 34, the loops can slide from the gripper edge 14 of the gripper section 13 onto the knife extension 19. The latter has, on its underside, a cutting edge 35 that is located at approximately the same height as the gripper edge 14. In other words, the height of the gripper section 13 that is to be measured between the gripper edge 14 and the back 17 corresponds substantially to the height of the knife extension 19 that is to be measured in the same direction, i.e., corresponds to the distance between the cutting edge 35 and the back 29. However, the cutting edge 35 is sharp at least in the transition region to the adjacent flat side in order to be able to cut the picked up loop. Preferably, the cutting edge 35 may account for two thirds of the length of the gripper section 14. As a result of this, a contact of the knife 6 with the gripper edge 14 of the gripper section 13 can be prevented.

Underneath the groove 24, in the vicinity of the knife extension 19, the counter knife element 4 is provided with a guide section 36 that may extend downward in the form of a wedge and may act to guide the knife 6.

Figure 5:
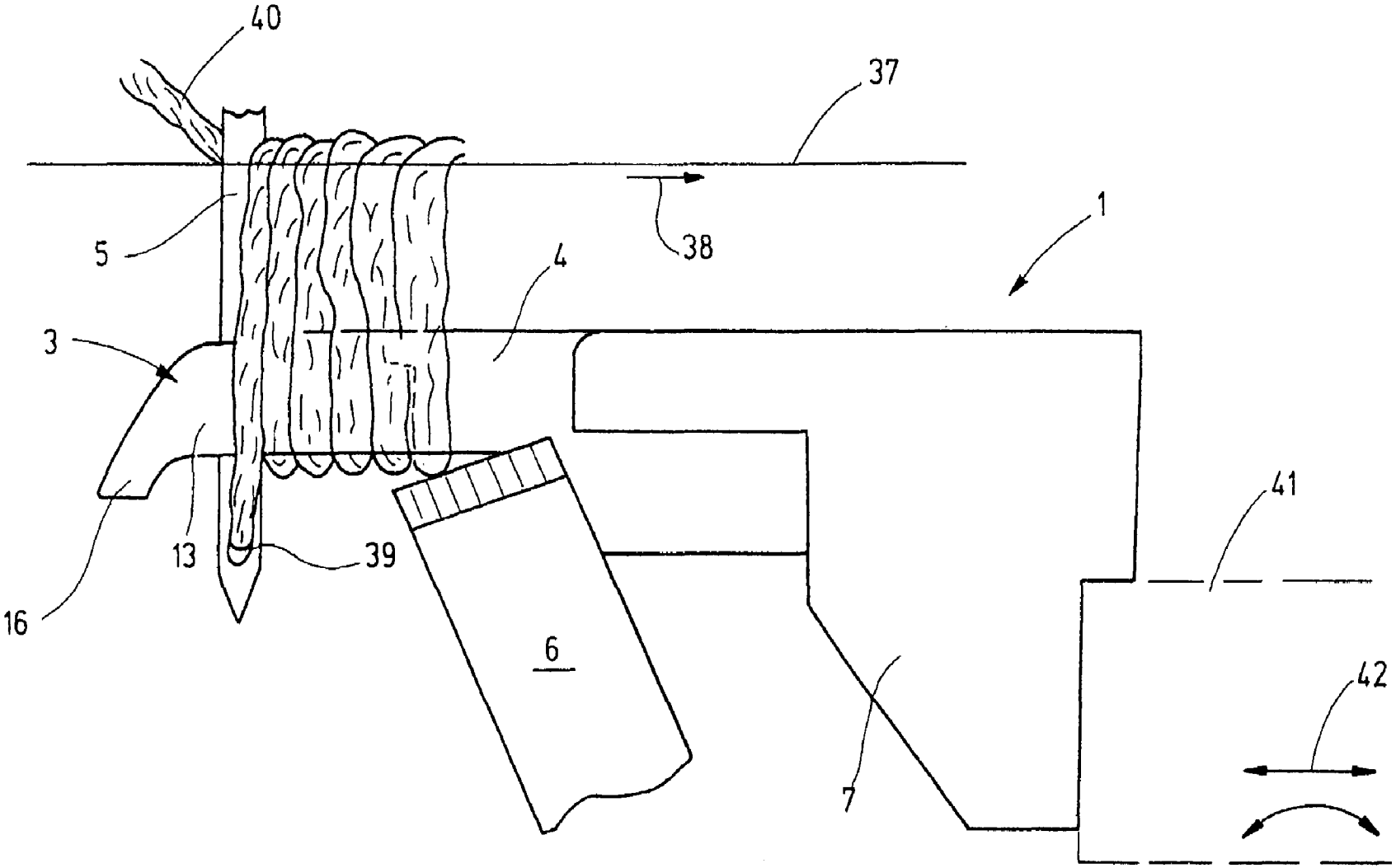
FIG. 5 is a schematic side view of the gripper device in accordance with FIGS. 1 and 2 when a loop is being picked up.
Figure 6:
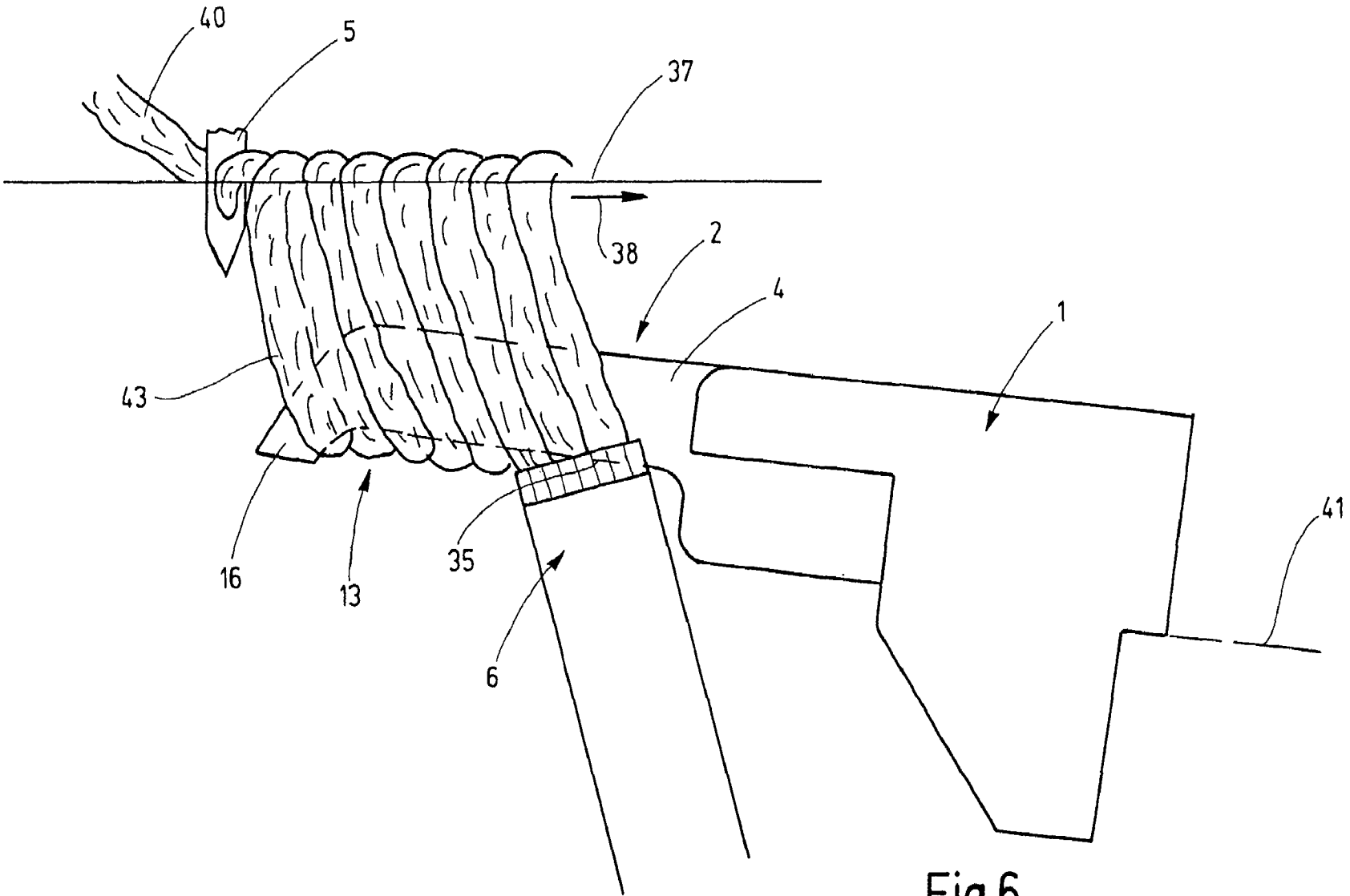
FIG. 6 is a schematic view of the gripper device in accordance with FIG. 5 in return stroke position, after a loop has been cut open.

The gripper module 1 described so far operates as follows:

As shown by FIG. 5, during the tufting process, a backing 37 is transported above the gripper module 1 in a transport direction indicated by an arrow 38. In so doing, the backing 37, as illustrated, may be passed above the gripper module 1, or said backing may be passed even in contact with said gripper module. The eyes 39 of the tufting needles 5 that are held in a bar pick up cut pile yarn 40 and punch it through the backing. After this has been done, the gripper module 1 that is held on a bar 41 is moved in such a manner that the gripper section 13 of the gripper 3 drops between the tufting needle 5 and the pile yarn that is tensioning toward the backing 37. The direction of movement carried out by the bar 41 is indicated by the arrow 42. The hook 16 prevents the picked up loop from sliding off the gripper section 13 during the return stroke of the tufting needle 5. Rather, the loop—as shown in FIG. 6 with reference to the loop 43—is continued to be held on the gripper section 13. Furthermore, FIG. 6 shows how the loops now held by the gripper device 2 are cut open by the knife 6. In so doing, the knife 6 interacts with the counter knife element 4, in that said knife cuts open the loops or stitches that have arrived—due to the continuous pick up of loops and due to the continuous movement of the backing 37—on the counter knife element 4. In so doing, cutting is effected by the interaction of the cutting edge of the knife 6 with the cutting edge 35 of the counter knife element 4.

As is obvious, the gripper 3 cooperates with the tufting needle 5, whereas the counter knife element 4 interacts with the knife 6. The gripper 3 and the counter knife element 4 can be optimized individually regarding the material selected for them. For example, the gripper 3 and the counter knife element 4 may be made of different types of steel having different material compositions or have been subjected to different treatments. In so doing, it is possible to minimize the wear of needles, on the one hand, and the wear of knives and counter knives, on the other hand. In addition, a precise operation of the gripper device 2 and precise interaction with the tufting needle 5 and with the knife 6 are made possible. Furthermore, the axial alignment of the gripper edge 14 and the cutting edge 35 relative to each other result in a safe and uninterrupted loop transport from the gripper 3 to the counter knife element 4.

Referring to the described embodiment, the idea of separating the gripper function from the cutting function and of distributing of these functions to the gripper and the counter knife element 4 has been illustrated with the use of a gripper device 2, in which the gripper 3 and the counter knife element 4 are supported such that they cannot be adjusted or moved relative to each other.

A gripper device in accordance with the invention comprises a gripper 3 and a counter knife element 4 that are fabricated separately and joined. The gripper module 1 accommodates the counter knife element 4, which, in turn, supports the gripper 3. The two parts may be joined by caulking, cementing, riveting, screwing or similar measures, or they may be cast together in the gripper module 1. The counter knife element may account for the rear two thirds of the cutting surface 35 of the gripper edge 14. At the same height, the cutting surface 35 of the counter knife element 4 becomes the gripper edge 14 of the gripper 3. The transition regions have inclined surfaces or overlaps that are designed in such a manner that the loop will not become stuck in them, and the filaments of the yarn will not become caught in them. The cutting operation is performed exclusively between the counter knife element 4 and the knife 6. As a result of this, optimal material combinations are possible, which will deal with both types of wear, namely between the gripper 3 and the tufting needle 5, on the one hand, and between the knife 6 and the counter knife element 4, on the other hand. The precision of the gripper 3 and the counter knife element 4 can be such, that the set-up times after machine retro-fitting are shortened. The knife pressure no longer acts directly on the gripper 3 and, consequently, no longer on the needle, thus resulting in an improvement in the useful life of the needle. The gripper 3 is no longer deflected as much, thus resulting in savings regarding set-up time and resulting in less damage due to strong residual bending. The counter knife element 4 and the gripper 3 may be replaced separately.

LIST OF REFERENCE NUMBERS

1 Gripper module
2 Gripper device
3 Gripper
4 Counter knife element
5 Tufting needle
6 Knife
7 Body
8, 9, 10 Grooves
11, 12 Bores
13 Gripper section
14 Gripper edge
15 End
16 Hook
17 Back
18 Step
19 Knife extension
20 Shaft
21 Step
22, 23 Cutouts
24 Groove
25, 26 Flanks
27, 28 Step
29 Back
30, 31 Cutouts
32, 33 Strips
34 Face
35 Cutting edge
36 Guide sections
37 Backing
38 Arrow
39 Eye
40 Pile yarn
41 Bar
42 Arrow
43 Loop

The invention claimed is:

1. Gripper device for a tufting machine, in particular for the manufacture of carpets with cut pile, comprising a gripper having at least one first gripper section with a gripper edge for picking up loops, and a counter knife element for accepting the loops from the gripper element, wherein the counter knife element has a cutting edge that is associated with a knife, and wherein the counter knife element and the gripper are separate elements, with the gripper being removably mounted on and supported by the counter knife element.

2. Gripper device as in claim 1, wherein the gripper edge is straight.

3. Gripper device as in claim 1, wherein the cutting edge is straight.

4. Gripper device as in claim 1, wherein the gripper edge and the cutting edge are aligned parallel to each other.

5. Gripper device as in claim 1, wherein the gripper edge and the cutting edge adjoin each other.

6. Gripper device as in claim 1, wherein the gripper has a hook on its end.

7. Gripper device as in claim 1, wherein the gripper has a shaft, which is accommodated by a cutout of the counter knife element.

8. Gripper device as in claim 7, wherein the cutout is a groove.

9. Gripper device as in claim 1, wherein the gripper is immovably supported on the counter knife element.

10. Gripper device as in claim 1, wherein a flat side of the gripper abuts against the counter knife element.

11. Gripper device as in claim 1, wherein the counter knife element has a knife extension, which has the cutting edge and against which abuts the flat side of the gripper.

12. Gripper device as in claim 1, wherein the counter knife element and the gripper are made of different materials.

13. Gripper device as in claim 1, wherein the counter knife element has a flat body portion for mounting the gripper device in a groove of a mounting block.

* * * * *